United States Patent [19]

Dickson

[11] Patent Number: 4,569,164

[45] Date of Patent: Feb. 11, 1986

[54] OPERABLE WALL SYSTEM

[75] Inventor: Wesley B. Dickson, Brea, Calif.

[73] Assignee: Advanced Equipment Corp., Anaheim, Calif.

[21] Appl. No.: 483,180

[22] Filed: Apr. 8, 1983

[51] Int. Cl.[4] ..... E05D 16/26

[52] U.S. Cl. ..... 52/64; 160/206; 160/196 R; 49/127; 49/130

[58] Field of Search ..... 52/64, 71; 49/125, 127, 49/130; 160/206, 196 R

[56] References Cited

U.S. PATENT DOCUMENTS

| | | | |
|---|---|---|---|
| 3,071,825 | 1/1963 | Ferris | 49/127 |
| 3,235,915 | 2/1966 | Glaser | 52/64 |
| 3,341,985 | 9/1967 | Haws | 52/64 |

FOREIGN PATENT DOCUMENTS

| | | | |
|---|---|---|---|
| 152677 | 10/1937 | Austria | 160/206 |
| 91792 | 10/1919 | Switzerland | 49/127 |
| 5765 | 1/1987 | United Kingdom | 49/125 |

*Primary Examiner*—Donald G. Kelly
*Assistant Examiner*—Kathryn L. Ford
*Attorney, Agent, or Firm*—Edward D. O'Brian; K. H. Boswell

[57] ABSTRACT

An operable wall system which is especially desirable for use with large and/or heavy wall panels can be constructed so that each panel in the system is supported from a track structure by two separate trolleys. The track structure includes a terminal section having two parallel end sections joined to the main portion of the track structure through a junction. This junction is provided with cams which cooperate with differently oriented flange wheels on successive trolleys so that the panels can be moved between a position in which they are aligned with one another beneath the main portion of the track structure and a position in which they are suspended from the end sections and are located in side by side relationship.

3 Claims, 7 Drawing Figures

FIG. 4.
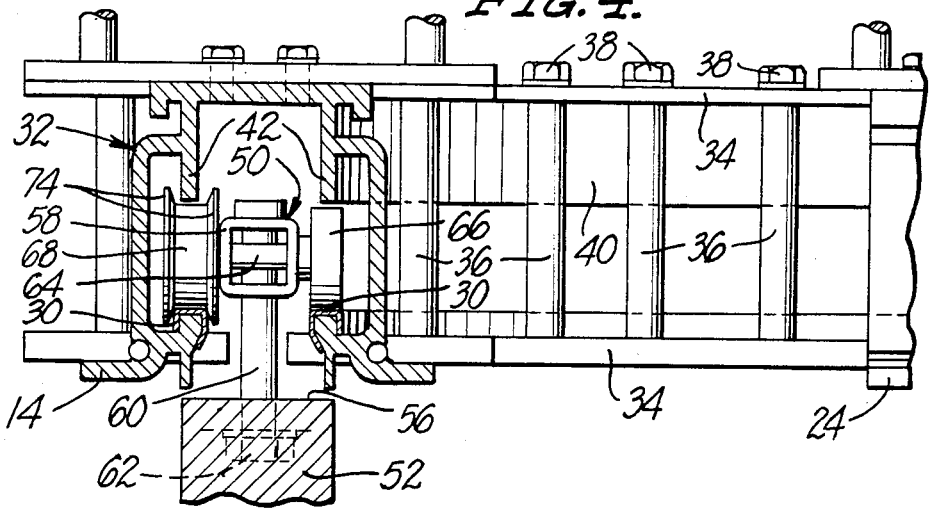
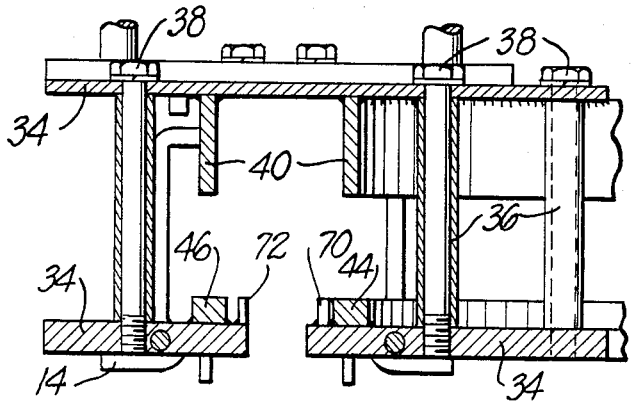
FIG. 5.
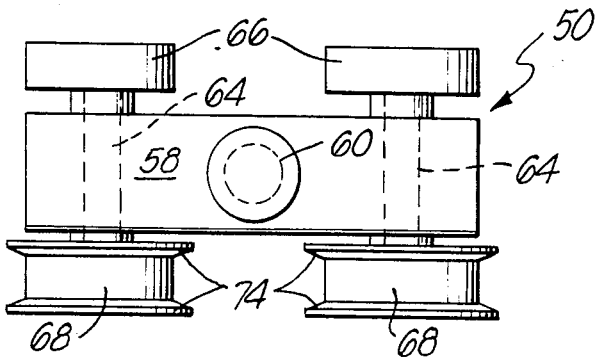
FIG. 6.
FIG. 7.
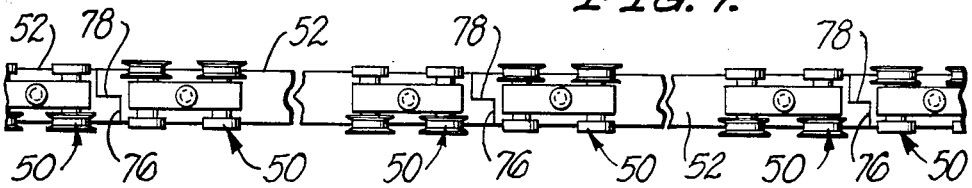

OPERABLE WALL SYSTEM

BACKGROUND OF THE INVENTION

This invention pertains to new and improved operable wall systems. More specifically it is directed to operable wall systems which are particularly adapted to include and/or use comparatively heavy and/or large wall panels.

The expressions "operable wall" and "operable wall system" are currently utilized to designate walls or partitions capable of being manipulated so as to divide a comparatively large room or space into two separate rooms or spaces and which are also, of course, capable of being manipulated so as to join two separate rooms or spaces into a single larger room or space. These operable walls or wall systems are commonly utilized in many different applications. They are frequently employed in connection with comparatively large meeting or banquet halls because they enable those responsible for the management of such establishments to provide either comparatively large or comparatively small rooms or spaces as needed in particular circumstances.

Such operable walls or operable wall systems have been constructed in a number of different ways. Virtually all of such operable walls or wall sytems include a type of track structure or track means, a plurality of elongated wall panels having upper edges generally adjacent to the track structure and a plurality of trolleys connecting the upper edge of the wall panels with the track structure in such a manner so as to permit the wall system to be manipulated between an open or unfolded configuration in which the panels are located in substantially an edge to edge relationship so as to define or form a partition or wall and a closed or folded configuration in which the panels are located adjacent to one another in a stacked or side by side orientation.

It is not considered that an understanding of the present invention requires a detailed discussion of all of the various different operable walls or wall systems which have been constructed so as to utilize parts as are described in the preceding connected or associated so as to obtain the mode of operation briefly indicated in this discussion. Most commonly, prior operable wall systems have utilized a single trolley in association with each wall panel employed in the system. Normally these trolleys have been located along the upper edges of the wall panels and the panels have been joined in edge to edge relationship by hinges or similar elements connecting the side edges of the panels.

Structures of this type are unquestionably highly utilitarian in many applications. However, structures of this type are not considered to be particularly desirable for use in operable walls or wall systems where, for one reason or another, it is necessary to utilize comparatively large and or heavy wall or similar panels. The reasons for this are also not discussed in this specification because it is considered that an understanding of this invention is unrelated to a detailed understanding of problems and complications encountered in connection with the particular type of prior known operable walls or operable wall systems noted in the prior discussion. It is considered important to note, however, that the present invention is related to a recognition of a need for new and improved operable walls or wall systems which can be utilized with comparatively large and/or heavy wall panels.

SUMMARY OF THE INVENTION

The present invention is intended to fulfill the need indicated in the preceding discussion. It is intended to provide new and improved operable walls or wall systems which may be easily and conveniently constructed at a comparatively nominal cost, which may be easily and conveniently manipulated in use between open or extended and closed or collapsed configurations and which are capable of giving prolonged, reliable service with comparatively limited maintenance. More specifically the invention is intended to provide operable wall or wall systems having these advantageous characteristics which are especially desirable for use with comparatively large or heavy wall panels. Obviously the relative difficulty of opening or closing any such operable wall or wall system will depend upon the weight and/or configuration of the panels used in it.

In accordance with this invention these various objectives are achieved by providing: an operable wall system which includes a track means, a plurality of wall panels located generally beneath said track means and having elongated upward edges positioned generally adjacent to said track means and a plurality of trolley means connecting said track means and the upper edges of said wall panels for suspending said wall panels from said track means in which the improvement comprises: said track means including a main track section, two terminal track sections and a junction section joining said main and said terminal track sections, portions of said terminal track sections generally remote from said junction section extending parallel to one another, said main and said terminal track sections each include two parallel, spaced tracks, said junction section includes a first connecting track section extending between said main section and a track with one of said terminal sections, a second connecting track extending between the other track of said main sections and the track of said other of said terminal sections and a track apex joining the remaining tracks on said terminal sections, said junction section also including a platform extending from said track apex generally towards said connecting track sections, a cam located on each of said first and said second connecting tracks, said trolley means includes two separate trolleys associated with each wall panel, said trolleys being spaced from one another and connecting the top edge of each of said wall panels with said track means, the trolleys associated with said wall panels being spaced the same distance apart, one of the trolleys attached to each of said wall panels including follower means capable of engaging one of said cams during the movement of the trolley upon which it is located through said junction section, the other of the trolleys attached to each of said wall panels including other follower means capable of engaging the other of said cams during the movement of the trolley upon which it is located through said junction section, said cams and said followers being capable of causing the movement of said trolleys so that as wall panels are moved from beneath said main track section they are located parallel to one another with a trolley on each of said wall panels being supported by each of said terminal track sections, each of said trolleys is shaped so as to engage both tracks of said main and said terminal track sections, each of said trolleys being capable of being moved through said junction section so that it is supported by said connecting tracks and said platform on said track apex during movement through it.

BRIEF DESCRIPTION OF THE DRAWING

Because of the nature of this invention it is best more fully explained with reference to the accompanying drawings in which:

FIG. 4 is a partial cross-sectional view at an enlarged scale taken at line 4—4 of FIG. 2;

FIG. 5 is a partial cross-sectional view at an enlarged scale taken at line 5—5 of FIG. 2;

FIG. 6 is a top plan view of a trolley as illustrated in FIG. 4; and

FIG. 7 is a top plan view showing trolleys as illustrated in the preceding figure attached to the top edges of wall panels as are shown in the prior FIG. 2.

Figure 1:
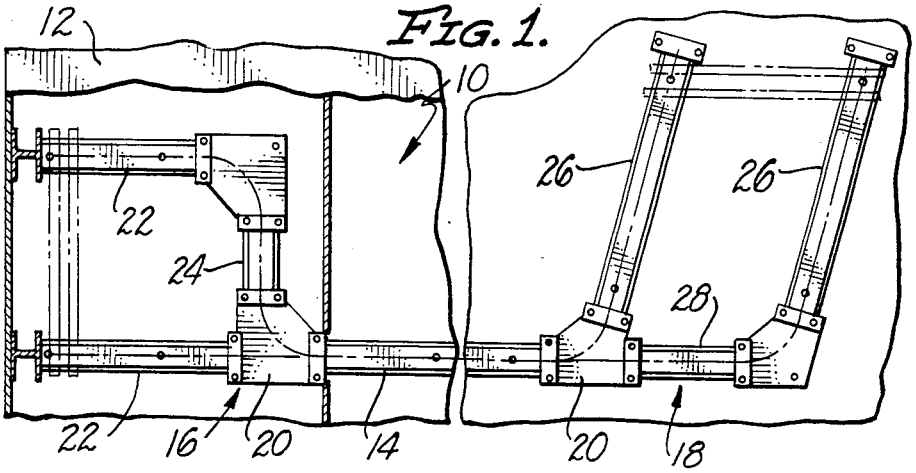
FIG. 1 is a top plan view of a presently preferred embodiment or form of an operable wall system in accordance with this invention.
Figure 2:
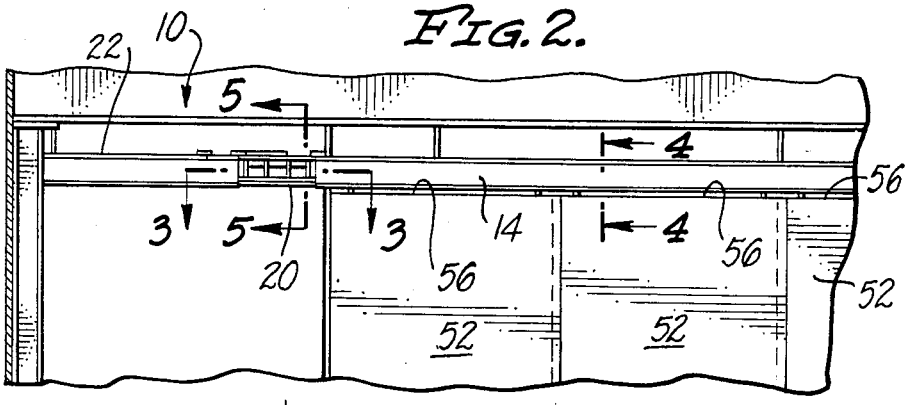
FIG. 2 is a front elevational view thereof.
Figure 3:
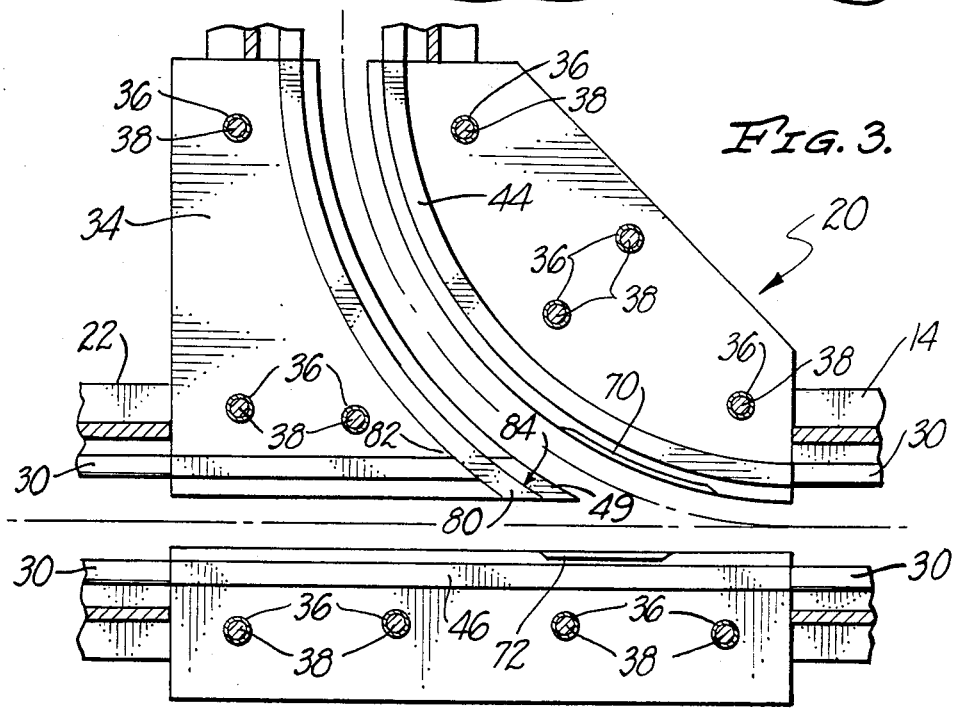
FIG. 3 is a partial cross-sectional view at an enlarged scale taken at line 3—3 of FIG. 2.

The particular operable wall system illustrated in the drawings is constructed so as to utilize the operative concepts or principles of the invention as are set forth and defined in the appended claims forming a part of this disclosure. Those skilled in the art of the construction and design of operable wall systems and components for such systems will realize that these concepts or principles can be easily embodied within quite a variety of somewhat differently appearing and differently constructed operable wall systems or units through the use or exercise of routine skill in the noted field. For this reason the accompanying drawings are not to be taken as limiting this invention in any respect.

DETAILED DESCRIPTION

In the drawings there is shown an operable wall system 10 of the present invention. In FIG. 1 this system 10 is viewed from the top as, for example, it would be viewed if a roof or ceiling 12 above the system was removed so as to expose the system 10. This system 10 is constructed so as to utilize a main track section 14 extending to either or both of two different terminal track sections 16 and 18. The section 14 is connected to these terminal track sections 16 and 18 by means of comparatively short junction sections 20.

It will be noted that the terminal sections 16 and 18 are somewhat different from one another. If desired two terminal sections may be identical. In the terminal section 16 two parallel, spaced end sections 22 are used in such a manner that one of these end sections 22 is aligned with the main track section 14 while the other end section 22 is connected to the main track section 14 through the junction section 20 by a small lateral section 24. As opposed to this the terminal section 18 is constructed so as to utilize two spaced, parallel end sections 26 which extend substantially perpendicular to the main track section 14. One of these end sections 26 is connected to the junction section 20 so as to appear more or less as an extension of the main track section 14 by a short extension section 28.

The various different sections 14, 16, 18, 22, 24, 26 and 28 are all constructed so as to include two upwardly directed, parallel, spaced tracks or rails 30. These rails 30 may be of any desired cross-sectional configuration and they may, if desired, be formed integrally with an extruded or otherwise formed channel 32 as illustrated in FIG. 4 of the drawings. The junction sections 20 in the system 10 include top and bottom plates 34 which are held with respect to one another by means of spacers 36 and bolts 38. These plates 34 extend between the adjacent channels 32 as shown and are secured to them by other bolts 38. Preferably the plates 34 are provided with downwardly directed parallel walls 40 corresponding in spacing and configuration with other downwardly directed parallel walls 42 in the channels 32.

The walls 40 are spaced from a first connecting track 44, a second connecting track 46 and a track apex 48 in the junction sections 20 as indicated in FIG. 5 of the drawings. The connecting track 44 is a curved track extending between a rail or track 30 in the main track section 14 and a corresponding rail or track 30 in either of the terminal track sections 16 or 18. Similarly, the second connecting track 46 is a short track section extending between a rail or track 30 in the main track section 14 and another rail or track 30 in the main track section 16 or 18. The track apex 48 in each of the junction sections 20 includes rails or tracks 30 which in affect are extensions of the rails or tracks 30 of the terminal track sections 16 which are not connected to the main track section 14. It also includes a small pointed tip 49 of the same height as the rails 30 which extends generally towards the section 14.

The system 10 utilizes with the various tracks described in the preceding a series of identical trolleys 50. These trolleys 50 are utilized to connect a series of vertically extending, comparatively large walls or panels 52 such as are sometimes referred to as doors, to the remainder of the system 10. Two of these trolleys 50 are used in connection with the upper edge 56 of each of the panels 52. These trolleys 50 are constructed so as to utilize a centrally located body 58 which carries a vertically extending center bolt 60 having a lower end 62 attached to a panel 52 in a conventional manner. Each of the trolleys 50 also includes two separate parallel cross shafts 64 mounted on its body 58.

Each of these shafts 64 carries a plain wheel 66 and a flanged wheel 68 as shown in FIGS. 6 and 7. The walls 40 and 42 are dimensioned so as to minimize the chances of these wheels 66 and 68 coming off of the tracks 30. It will be realized that the positions of the plain wheels 66 and the flanged wheels 68 are alternated by varying the orientation of the trolleys 50 so that along a particular track or rail 30 there will be first the flanged wheels 68 from one trolley, then the plain wheels 66 on the next trolley, followed by the flanged wheels on the third trolley and so on. This construction is desirable in achieving a type of folding action in which the panels 52 are stored next to one another in a side by side relationship on either of the terminal sections 16 or 18 on the end sections 22 or the end sections 26.

With the present invention small cams 70 and 72 are located on the first connecting track 44 and on the second connecting track 46, respectively in each junction section 20. These cams 70 and 72 are spaced from the tracks 44 and 46 slightly as shown so as to accomodate movement of the flanged wheels 68 but are positioned so as to engage the flanges 74 on these wheels 68 in order to be capable of directing the trolleys 50. Thus, as a trolley 50 is moved so that the flanges 74 on its wheels 68 engage a cam 70 such engagement will tend to cause rotation of the bolt 60 relative to the trolley 50, causing this trolley 50 to move generally in the direction of the connecting track or rail 44. Similar engagement of a flanged wheel 68 with a cam 72 will cause a trolley 50 to move along and in the direction a second connecting track or rail 46.

Because the action achieved with the flange 74 on the wheels 68 is analogous to that of a conventional cam follower these flanges 74 may be considered as cam followers which cooperate with the cams 70 and 72 so as to move the trolleys 50 in such a manner that each panel 52 is held out of alignment with the other panels 52 when a trolley 50 on it is removed from the main track section 14. When the trolleys 50 are located within the end sections 22 and 26 the panels 52 are held in side by side directly adjacent to one another in a neatly appearing stack.

In order to achieve this mode of operation it is, of course, necessary that the side edges 76 of the panels either be unattached or be connected in such a manner as to accomodate motion as described. Although it is possible to utilize flexible connectors such as fabric panels (not shown) between these edges 76 or to utilize various specialized hinge structures (not shown), neither of these expedients is normally considered necessary with the present invention. In most instances it is satisfactory to utilize small offsets 78 along the edges 76 which are shaped so that the edges 76 overlap slightly. If desired conventional tongue and groove type overlaps may be provided in lieu of these offsets 78.

An important aspect of the invention concerns the ease with which the trolleys 50 may be moved as they traverse the junction sections 20. This is related to the dimensions of the parts used on the trolleys 50 and, in addition, to the manner in which the junction sections 20 are constructed. The previously described tip 49 is important in connection with this. It and a portion 80 of one of the tracks 30 which extends beyond the nearly diamond shaped area 82 where the two tracks 30 intersect define a sort of a platform or a support 84 of the same height as the tracks 30 extending beyond the physical junction of the two tracks 30 adjacent to where they are located towards the connecting tracks 44 and 46 in a junction 20.

Because of the manner in which the cams 70 and 72 operate in conjunction with the flanged wheels 68 and because of the manner in which these flanged wheels 68 are oriented, this platform or support 84 is only contacted by plain wheels 66 as a trolley 50 is moved through a junction section 20. This platform or support 84 is located so as to be capable of picking up and holding a plain wheel 66 on a trolley 50 being moved generally into or through the junction section 20 from the track section 14 so that at all times one of the plain wheels 66 and two of the flanged wheels 68 on trolley 50 are supported. The bolts 60 are centrally located in connection with the trolleys 50 and the trolleys 50 including the wheels 66 and 68 are dimensioned so that the weight of a panel 52 will not cause an individual trolley 50 to tilt or cant in such a manner as to impede its progress through a junction section 20.

I claim:

1. An operable wall system which includes a track means, a plurality of wall panels located generally beneath said track means and having elongated upward edged positioned generally adjacent to said track means and a plurality of trolley means connecting said track means and the upper edges of said wall panels for suspending said wall panels from said track means in which the improvement comprises:

said track means including a main track section, two terminal track sections and a junction section joining said main and said terminal track sections, portions of said terminal track sections generally remote from said junction section extending parallel to one another, said main and said terminal track sections include tow parallel, spaced tracks, said junction section includes a first connecting track section extending between said main section and a track with one of said terminal sections, a second connecting track extending between the other track of said main sections and the track of said other of said terminal sections and a track apex joining the remaining tracks on said terminal sections, said junction section also including a platform extending from said track apex generally towards said connecting track sections, a cam located on each of said first and said second connecting tracks, said trolley means includes two separate trolley sections associated with each wall panel, said trolleys being spaced from one another and connecting the top edge of each of said wall panels with said track means, the trolleys associated with said wall panels being spaced the same distance apart, one of the trolleys attached to each of said wall panels including follower means located on only one side thereof capable of engaging one of said cams during the movement of the trolley upon which it is located through said junction section, the other of the trolleys attached to each of said wall panels including follower means located only on the other side thereof capable of engaging the other of said cams during the movement of the trolley upon which it is located through said junction section, said cams and said follower being capable of causing the movement of said trolleys so that as wall panels are moved from beneath said main track section they are located parallel to one another with a trolley on each of said wall panels being supported by each of said terminal track sections, and each of said trolleys is shaped so as to engage both tracks of said main and said terminal track sections, each of said trolleys being capable of being moved through said junction section so that it is supported by said connecting tracks and said platform on said track apex during movement through it.

2. An operable wall system as claimed in claim 1 wherein:

said trolley means include wheels spaced so as to engage said tracks, said connecting track section and said track apex during movement of said trolleys, and said follower means include flanges on some of said wheels.

3. An operable wall system which includes a track means, a plurality of wall panels located generally beneath said track means and having elongated upward edges positioned generally adjacent to said track means and a plurality of trolley means connecting said track means and the upper edges of said wall panels for suspending said wall panels from said track means in which the improvement comprises:

said track means including a main track section, two terminal track sections and a junction section joining said main and said terminal track sections, portions of said terminal track sections generally remote from said junction section extending parallel to one another, said main and said terminal track sections each include two parallel, spaced tracks, said junction section includes a first connecting track section extending between said main section and a track with one of said terminal sections, a second connecting track extending between the other track of said main sections and the track of said other of said terminal sections and a track apex joining the remaining tracks on said terminal sections, said junction section also including a platform extending from said track apex generally towards said connecting track sections, a cam located on each of said first and said second connecting tracks, said trolley means includes two separate trolleys associated with each wall panel, said trolleys being spaced from one another and connecting the top edge of each of said wall panels with said track means, the trolleys associated with said wall panels being spaced the same distance apart, one of the trolleys attached to each of said wall panels including follower means capable of engaging one of said cams during the movement of the trolley upon which it is located through said junction section, the other of the trolleys attached to each of said wall panels including other follower means capable of engaging the other of said cams during the movement of the trolley upon which it is located through said junction section, said cams and said followers being capable of causing the movement of said trolleys so that as wall panels are moved from beneath said main track section they are located parallel to one another with a trolley on each of said wall panels being supported by each of said terminal track sections, and each of said trolleys is shaped so as to engage both tracks of said main and said terminal track sections, each of said trolleys being capable of being moved through said junction section so that it is supported by said connecting tracks and said platform on said track apex during movement through it, said trolley means also includes wheels spaced so as to engage said tracks, said connecting track section and said track apex during movement of said trolleys, and said follower means include flanges on some of said wheels, each of said trolleys is pivotally attached to the upper edge of the wall panel upon which it is located, and each of said trolleys includes two axles and a wheel located on each end of each axle, the wheels located on one side of each of said trolleys being flanged, the wheels located on the other side of each of said trolleys being plain, the two trolleys on each of said panels being positioned so that the flanged wheels on them are adjacent to the opposite sides of the panel on which they are located, the trolleys on successive of said panels being oriented in the same way.

* * * * *

UNITED STATES PATENT AND TRADEMARK OFFICE

CERTIFICATE OF CORRECTION

PATENT NO. : 4,569,164

DATED : FEBRUARY 11, 1986

INVENTOR(S) : WESLEY B. DICKSON

It is certified that error appears in the above-identified patent and that said Letters Patent is hereby corrected as shown below:

Column 5, line 62, "edged" should be --edges--.

Signed and Sealed this

*Fifteenth* Day of *July 1986*

[SEAL]

*Attest:*

DONALD J. QUIGG

*Attesting Officer*

*Commissioner of Patents and Trademarks*